US005673329A

United States Patent [19]

Wiener

[11] Patent Number: 5,673,329

[45] Date of Patent: Sep. 30, 1997

[54] OMNI-DIRECTIONAL LOUDSPEAKER SYSTEM

[76] Inventor: David Wiener, 10 Iron Canyon Ct., Park City, Utah 84060

[21] Appl. No.: 410,142

[22] Filed: Mar. 23, 1995

[51] Int. Cl.[6] ..... H04R 25/00

[52] U.S. Cl. ..... 381/160; 381/89; 381/88; 381/90; 381/158; 181/144; 181/145; 181/153; 181/155; 181/196

[58] Field of Search ..... 381/89, 88, 90, 381/151, 158, 159, 160; 181/151, 141, 144, 146, 145, 147, 155, 153, 196

[56] References Cited

U.S. PATENT DOCUMENTS

| | | | |
|---|---|---|---|
| 3,816,672 | 6/1974 | Gefvert et al. | 179/115.5 R |
| 4,038,499 | 7/1977 | Yeaple | 381/24 |
| 4,164,988 | 8/1979 | Virva | 181/155 |
| 4,227,050 | 10/1980 | Wilson | 179/1 |
| 4,501,934 | 2/1985 | Wiener | 179/146 E |
| 4,907,671 | 3/1990 | Wiley | 181/156 |
| 5,115,882 | 5/1992 | Woody | 181/144 |

FOREIGN PATENT DOCUMENTS

| | | | |
|---|---|---|---|
| 2325603 | 12/1974 | European Pat. Off. | 181/153 |
| 1077151 | 11/1954 | France | 181/155 |

OTHER PUBLICATIONS

SAS Mobil Audio Bazooka Series Two Brochure.

Omni Speaker GS–350 advertisement.

Sonic Systems, Inc. Soundsphere brochure

SAS Response Newsletter, Special Edition Consumer Electronic Show 1995.

Pioneer CSL–250/CSL–300 brochure.

Audiodyne Omni Flex Brochure.

Canon's Q & A advertisement for the S–30 and S–35 speakers.

Radio Shack's advertisement for Optimus Wind Angle Sound by Linaeum.

Aiwa's advertisement for MiniMax NSX–4000.

"Earphones vs. Speakers", New York Times, Jun. 27, 1982 edition, section 2, p. 21, col. 1.

"An Enduring Speaker Idea Takes a Cue from Concerts", New York Times, Mar. 18, 1984, section 2, p. 23, col. 4.

"Streamlining Speakers", New York Times, May 26, 1985, Section 2, p. 15, col. 5.

"Ingenious Tricks in Speakers", New York Times, Sep. 4, 1988, section 2, p. 25, col. 1.

(List continued on next page.)

*Primary Examiner*—Curtis Kuntz
*Assistant Examiner*—Duc Nguyen
*Attorney, Agent, or Firm*—David P. Gordon

[57] ABSTRACT

A loudspeaker system includes a flexible compressible tube having a woofer mounted at one end with its cone directed outward, and a vented baffle mounted at the other end. A first sound dispersion element is mounted with its apex facing the cone of the woofer and a midrange speaker is mounted in the base of the dispersion element with its cone facing away from the tube. A second sound dispersion element is mounted with its apex facing the cone of the midrange speaker, and at least one tweeter is mounted on the base of the second sound dispersion element with its cone facing away from the tube. According to one embodiment, a plurality of tweeters are mounted in an enclosure mounted on the base of the second dispersion element. According to another embodiment, a single tweeter is mounted in the base of the second dispersion element and a third dispersion element is mounted with its apex facing the cone of the tweeter. According to a preferred embodiment of the invention, a pair of tubes are coupled to each other at their baffles to form a stereo speaker system. A fabric sleeve having a graphic display which may include an advertisement fits over the tubes. In order to enhance the aesthetic appearance of the speaker system and to protect the speakers from the environment, a fabric covering is optionally provided over the speakers and dispersion elements.

31 Claims, 13 Drawing Sheets

OTHER PUBLICATIONS

"Tannoy M20 speaker a design worthy of a venerable name", Chicago Tribune, May 10, 1991, p. 70.

"Best THX sound may be at home", Chicago Tribune, Aug. 16, 1991, p. 63.

"Not Seeing is Relieving, Sound Advance Systems Builds Thin, Flat Speakers That Can Be Hidden Inside Walls or Ceilings", The Los Angeles Times, Part D, p. 5, col. 2.

"Maker fires up with new product", South China Morning Post, Supplement, p. 3.

"Canon sounds out stereo market", South China Morning Post, Supplement, p. 3.

OMNI-DIRECTIONAL LOUDSPEAKER SYSTEM

This application is related to co-owned U.S. Pat. No. 4,501,934, the complete disclosure of which is incorporated herein by reference.

BACKGROUND OF THE INVENTION

1. Field of the Invention

The invention relates to loudspeakers. More particularly, the invention relates to a loudspeaker system incorporating a flexible tube with a plurality of speakers mounted at opposite ends of the tube and a plurality of sound reflecting lenses which are mounted adjacent to the speakers.

2. State of the Art

The art of loudspeaker system design involves many variables which affect the fidelity of sound reproduction. One of these variables is the dispersion angle of sound waves generated by the loudspeakers. Traditionally, loudspeakers were mounted in rectilinear boxes with their cones directed in a single direction toward the listener. Prior art FIG. 1 shows the sound dispersion characteristics of this type of speaker system 10, 12 where the shaded area 14 represents the sweet spot or hot spot within which a listener will hear both stereo channels at substantially the same amplitude. In 1968, Dr. Amar Bose developed the now famous Bose 901 loudspeaker system which incorporated a number of unorthodox innovations. The most memorable feature of the Bose 901 loudspeaker system is the placement of nine speakers which are directed not at the listener, but the wall in back of the loudspeaker system. The wall reflects the sound waves to provide a perceived spatial enlargement and a better dispersion of the sound waves. A single speaker directed at the listener provides a point placement of the source of stereo channels. The enhanced dispersion pattern achieved by the Bose 901 system is shown schematically in prior art FIG. 2, where the shaded area 16 represents the stereo hot spot. The only real disadvantage of the Bose 901 speaker system is that it must be placed near a wall in order to achieve its superior performance.

More recent loudspeaker system designs attempt to provide better sound wave dispersion by incorporating sound reflectors or dispersion lenses as part of the loudspeaker enclosure. For example, U.S. Pat. No. 3,816,672 to Gefvert et al. discloses a sound reproduction system which includes three vertically mounted speakers, a woofer, midrange speaker, and tweeter. The midrange speaker and tweeter have their respective cones directed upward toward respective radial dispersion elements and the woofer has its cone directed downward into a sound damping enclosure. The dispersion elements each have a concave surface which resembles a truncated one sheet hyperboloid. The surface of each dispersion element is directed toward the cone of a speaker and reflects sound waves from the speaker radially outward from the speaker system. While conceptually, this speaker system can achieve an excellent dispersion of sound, the enclosure is bulky, heavy, and must be mounted vertically on a floor. Substantially all of the woofer cone is exposed to dust or foreign objects which may damage it. U.S. Pat. No. 4,907,671 discloses a loudspeaker with a dispersion reflector which is adjustable to alter the direction of the dispersal pattern in the listening area. The dispersion pattern achieved by this speaker system is substantially cardioid shaped as shown in prior art FIG. 3 where the stereo sweet spot between speakers 18 and 20 is shown as the shaded area 22.

Co-owned U.S. Pat. No. 4,501,934 discloses a loudspeaker system which incorporates a flexible, compressible tube wherein first and second speakers are mounted inside the tube with their cones facing opposite ends of the tube. The speakers are mounted close to the ends of the tube, but recessed a certain distance from the ends depending on acoustic variables. The SoundTube® may be suspended from a ceiling with its ends drooping down so that sound from the speakers is directed down from the tube. Alternatively, the SoundTube® may be placed on a shelf or an article of furniture such as the back of a sofa. The speakers inside the tube, particularly the woofers, cause the tube to vibrate and this contributes to an enhanced dispersal pattern. When the SoundTube® is placed on the back of a sofa, listeners sitting on the sofa can feel the sound as well as hear it. The SoundTube® may be collapsed and placed in a duffel bag for easy transport. Moreover, the SoundTube® presents a unique appearance which may be aesthetically incorporated into an interior or exterior design.

SUMMARY OF THE INVENTION

It is therefore an object of the invention to provide a loudspeaker system which has an enhanced sound dispersion pattern.

It is also an object of the invention to provide a loudspeaker system which presents a unique appearance.

It is another object of the invention to provide a loudspeaker system which has an adaptable appearance and which can be used as a promotional device.

It is also an object of the invention to provide a loudspeaker system which can be mounted in many different locations.

It is still another object of the invention to provide a loudspeaker system which incorporates both left and right stereo channels in enclosures which may be coupled to each other to form a single enclosure having both left and right channels.

It is yet another object of the invention to provide a loudspeaker system which has a flexible enclosure which can be bent, compressed, or expanded without an adverse affect on sound reproduction.

It is still another object of the invention to provide a loudspeaker system which has a flexible enclosure which flexes in such a way to discourage standing waves.

In accord with these objects which will be discussed in detail below, the loudspeaker system of the present invention includes a flexible compressible tube having a woofer mounted at one end with its cone directed outward, and a vented baffle mounted at the other end. A conical sound dispersion element is mounted at one end of the tube with its apex facing the cone of the woofer and a midrange speaker is mounted in the base of the dispersion element with its cone facing away from the tube. A convex sound dispersion element is mounted to the base of the conical dispersion element with its convex surface facing the cone of the midrange speaker, and at least one tweeter is mounted on the base of the convex sound dispersion element with its cone facing away from the tube. According to one embodiment, a plurality of tweeters are mounted in an enclosure which is mounted on the base of the convex dispersion element. According to another embodiment, a single tweeter is mounted in the base of the convex dispersion element and a second convex dispersion element is mounted on the base of the first convex dispersion element with its convex surface facing the cone of the tweeter. The tube may be mounted vertically from a ceiling or on a floor or may be suspended horizontally. According to a preferred embodiment of the invention, a pair of tubes are coupled to each other at their baffles to form a single stereo speaker system which may be suspended from a ceiling or otherwise supported horizontally. The preferred embodiment of the invention also includes an interchangeable fabric sleeve which fits over a single tube or a coupled pair of tubes to conceal their coupling and to provide a graphic surface (display) which may include a promotional graphic, logo, or advertisement. In order to enhance the aesthetic appearance of the speaker system and to protect the speakers from the environment, a fabric covering is optionally provided over the speakers and dispersion elements. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
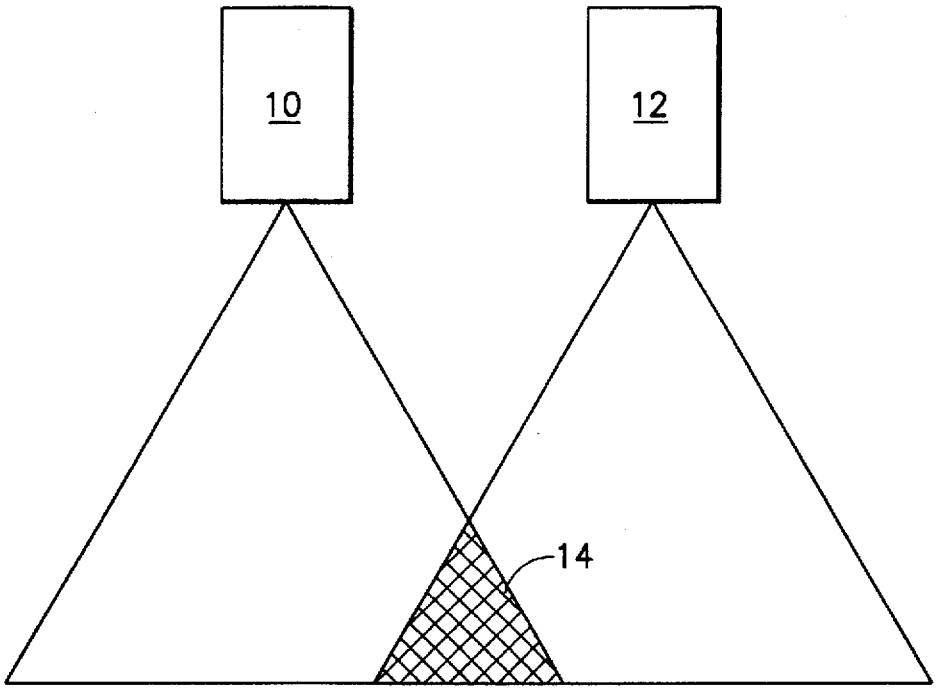
FIG. 1 PRIOR ART
FIG. 1 is a schematic view of the dispersion pattern of a first prior art speaker system.
Figure 3:
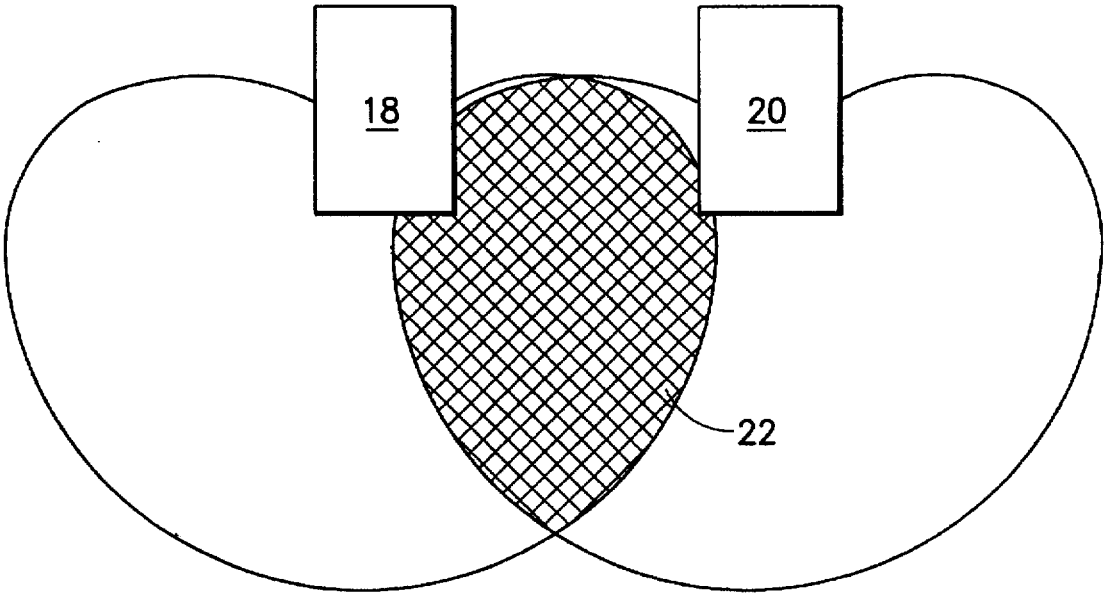
FIG. 3 PRIOR ART
FIG. 3 is a schematic view of the dispersion pattern of a third prior art speaker system.
Figure 2:
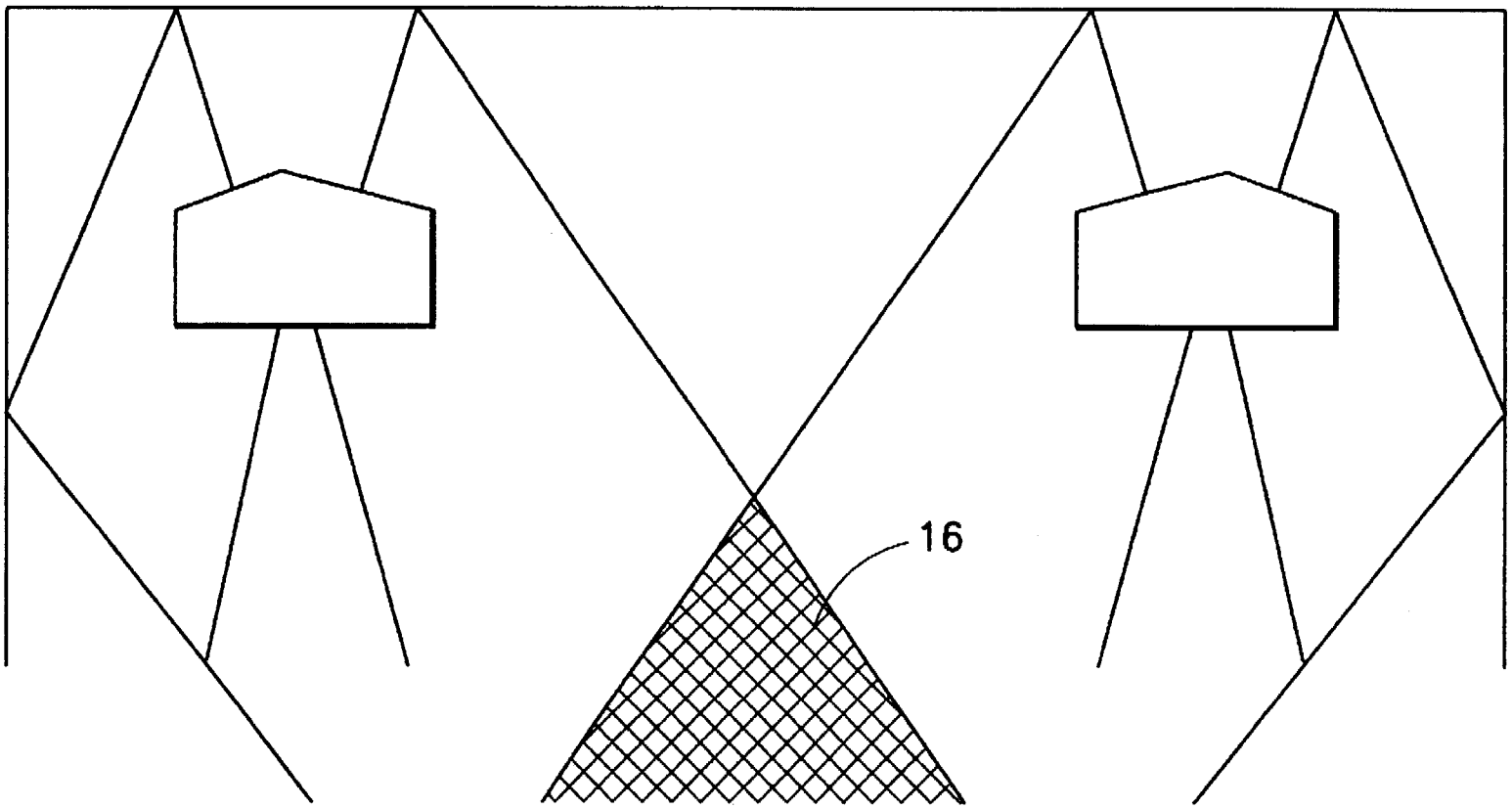
FIG. 2 PRIOR ART
FIG. 2 is a schematic view of the dispersion pattern of a second prior art speaker system.
Figure 4A:
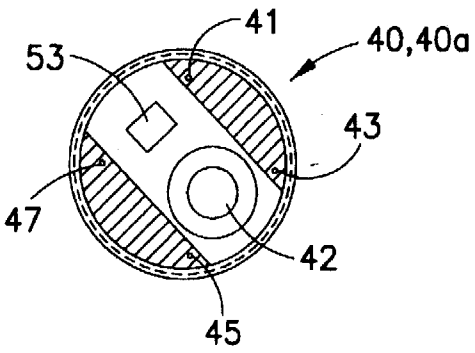
FIG. 4*a* is an end view of the loudspeaker system of FIG. 4.
Figure 4:
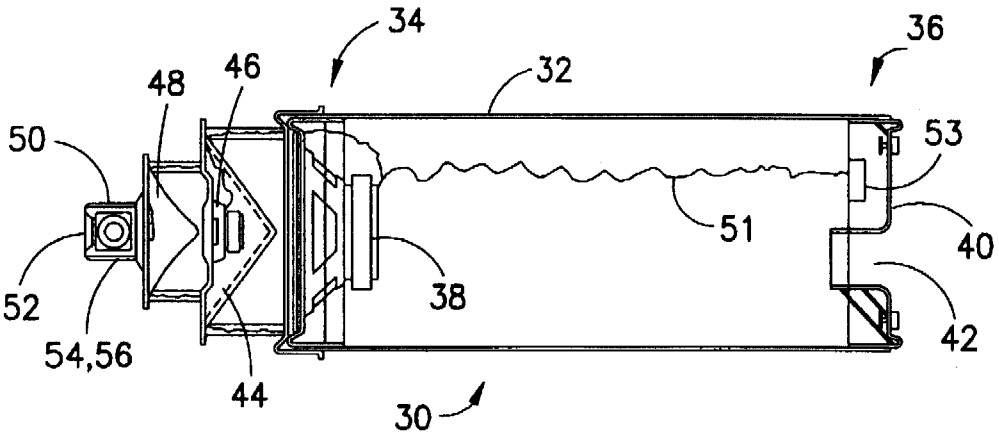
FIG. 4 is a transparent longitudinal side elevation view of a first embodiment of a loudspeaker system according to the invention.
Figure 13:
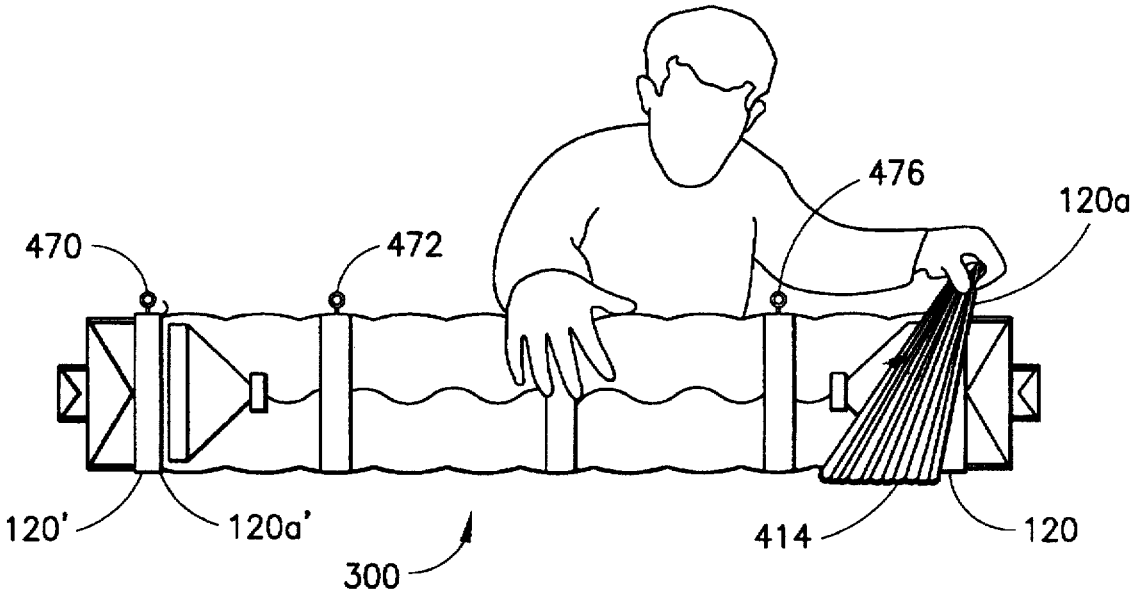
FIGS. 13, 13*a*, and 13*b* are a schematic side elevation views of a loudspeaker system according to the invention during the process of installing a removable fabric sleeve.
Figure 13A:
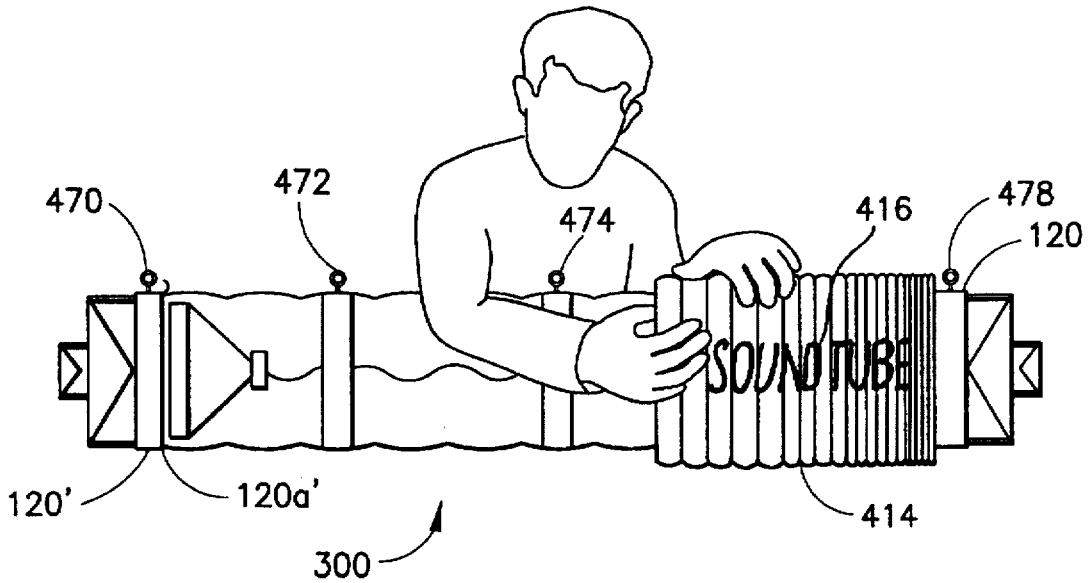
Figure 13B:
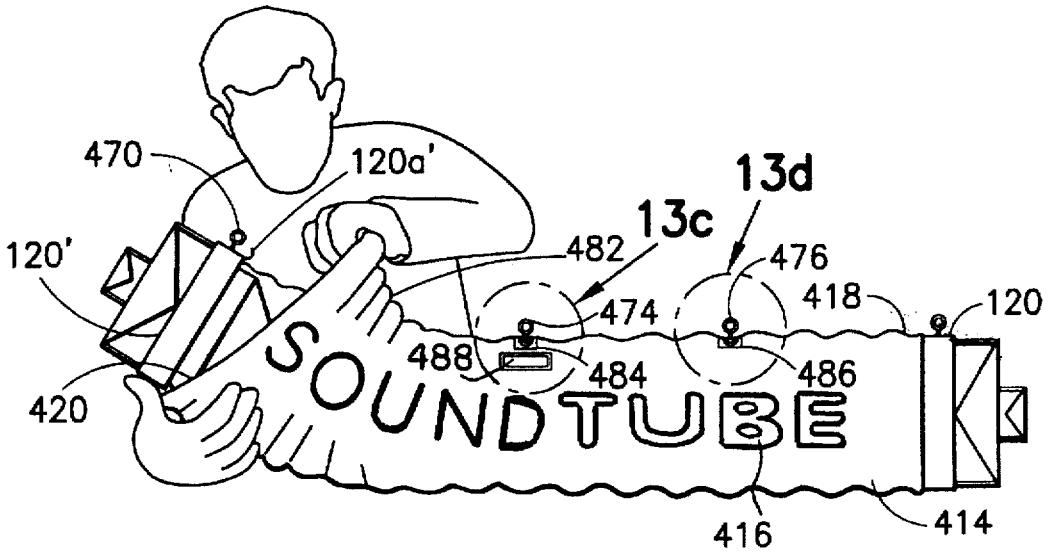
Figure 13C:
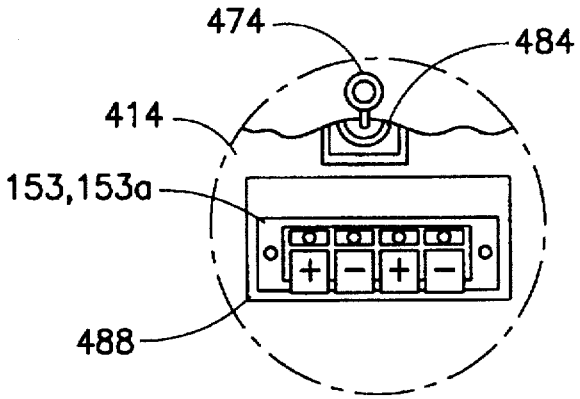
FIGS. 13*c* and 13*d* are enlarged detail views of portions of FIG. 13*b*.
Figure 13D:
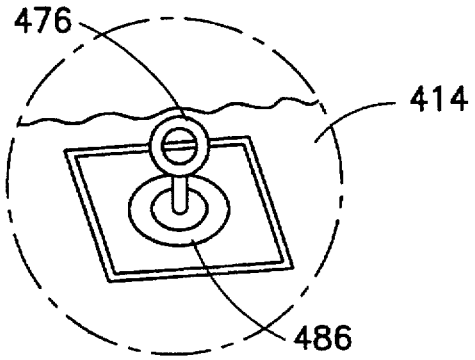

Referring now to FIGS. 4 and 4*a*, a loudspeaker system 30 according to the invention generally includes a flexible compressible tube 32 having first and second open ends 34, 36. A woofer 38 is mounted at the first end 34 of the tube and substantially closes the first end with its cone facing out of the tube. A vented baffle 40 is mounted at the second end 36 of the tube and substantially closes the second end except for the vent hole 42 which allows air to enter and exit the tube as described below. A first substantially conical sound dispersion element or "lens" 44 is mounted on the first end 34 of the tube 32 so that its apex faces the cone of the woofer 38. A midrange speaker 46 is mounted in the base of the lens 44 with its cone facing away from the tube 32, and a second sound dispersion element or lens 48 is mounted on the base of the first lens 44. The second lens 48 is substantially conical, but with a convex surface, i.e. a quadratic surface of rotation. The apex of the second lens 48 faces the cone of the midrange speaker 46 and a tweeter housing 50 is mounted on the base of the second lens 48. The tweeter housing preferably includes a plurality of tweeters 52, 54, 56 which are oriented to face in different directions. Those skilled in the art will appreciate that the tweeters 52–56, the midrange speaker 46, and the woofer 38 are coupled by wires 51 to a crossover 53 and the crossover 53 is coupled to an audio source by terminals (153, 153*a* in FIG. 13*c*) and/or a wire (not shown).

Figure 4B:
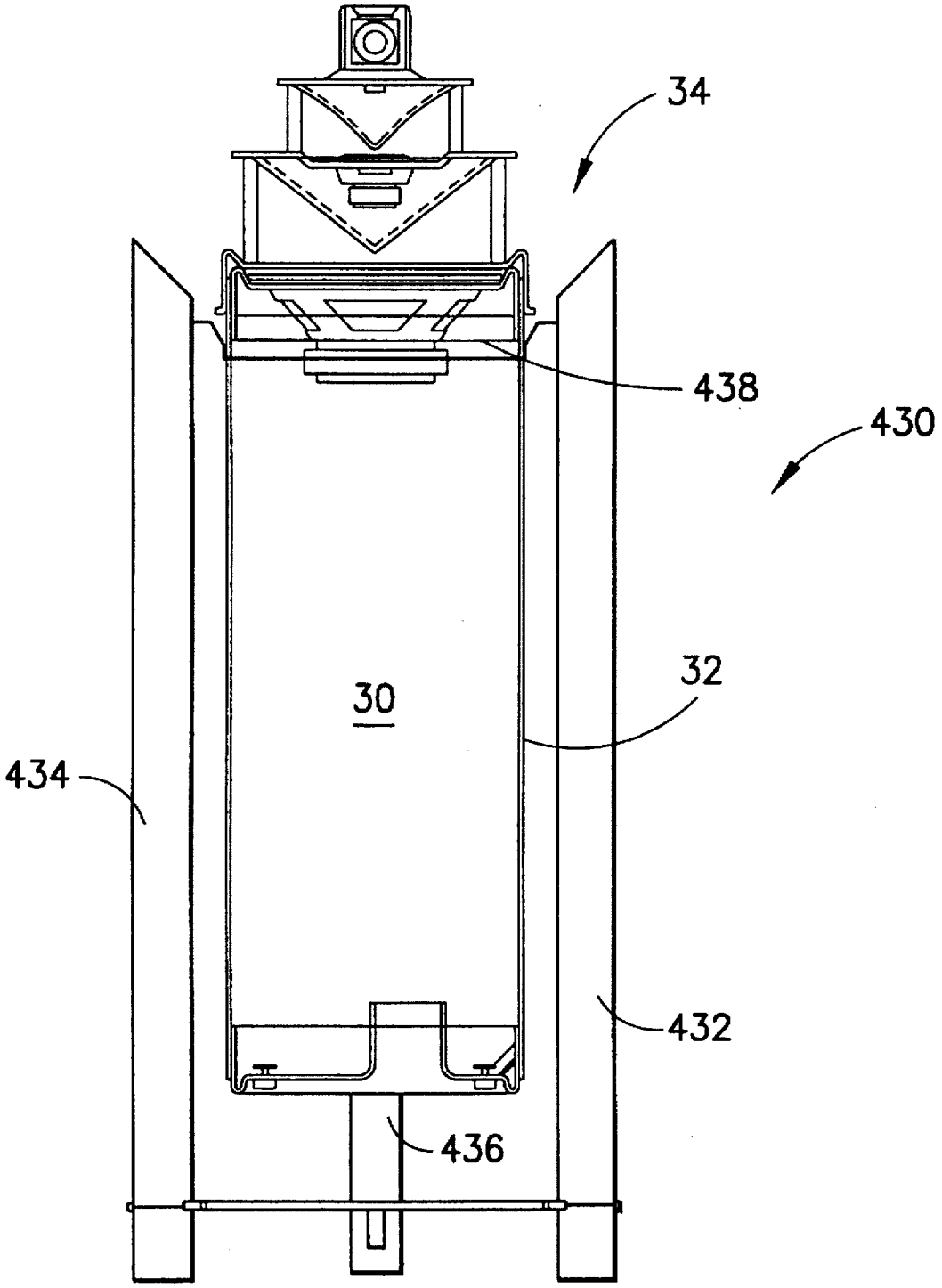
FIG. 4*b* is a transparent vertical side elevation view of the loudspeaker system of FIG. 4 mounted in a vertical stand.

The loudspeaker system 30 of FIGS. 4 and 4*a* may be mounted in any of a number of ways either horizontally or vertically. FIG. 4*b* shows a mounting stand 430 for supporting the loudspeaker system 30 in a vertical position. The mounting stand 430 generally includes three vertical support members 432, 434, 436 and a circular support collar 438 which is supported by the vertical members. The tube 32 of the loudspeaker system 30 is inserted through the collar 438 and the first end 34 of the tube 32 is supported by the collar 438.

Figure 5:
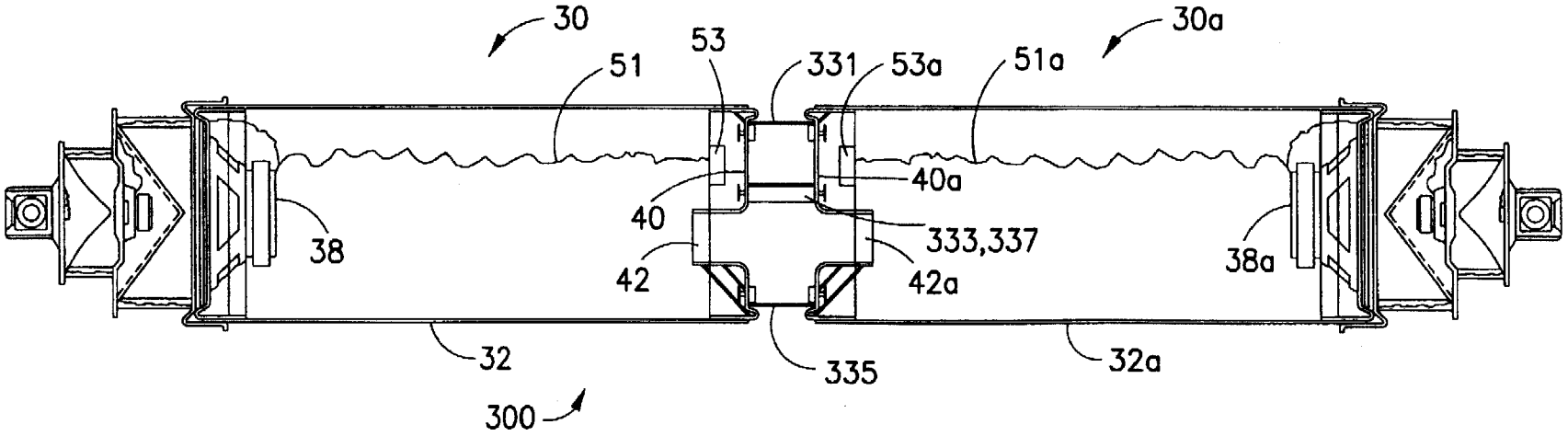
FIG. 5 is a view similar to FIG. 4 showing two loudspeaker systems coupled to each other to form a single stereo loudspeaker system.

According to a presently preferred embodiment, shown in FIG. 5, a pair of substantially identical loudspeaker systems 30, 30*a* are coupled to each other to form a single stereo loudspeaker system 300. The systems 30 and 30*a* are preferably coupled to each other by a plurality of connecting brackets 331, 333, 335, 337 which connect by screws to holes 41, 43, 45, 47 in the respective baffles 40, 40*a* of the systems 30, 30*a*.

As mentioned above, the tubes 32, 32*a* are flexible and compressible and are preferably made of a PVC containing an integral helical wire frame. A suitable material is sold under the name R2 by Flexaust Corp. and is available in various lengths and diameters. A presently preferred embodiment of the stereo loudspeaker system 300 has an outer diameter of approximately 14 inches and an expanded length of approximately 120 inches, though various diameters and lengths may be used. The compressible tubes 32, 32*a* can be compressed to approximately one quarter their expanded lengths. As mentioned above, the baffles 40, 40*a* are provided with vents 42, 42*a* which allow air to enter and exit the tubes 32, 32*a* so that they may be easily expanded and compressed and also to protect the woofers 38, 38*a* which modulate the air inside the tubes 32, 32*a* as well as aiding the ultimate sound quality and performance of the system.

Figure 5A:
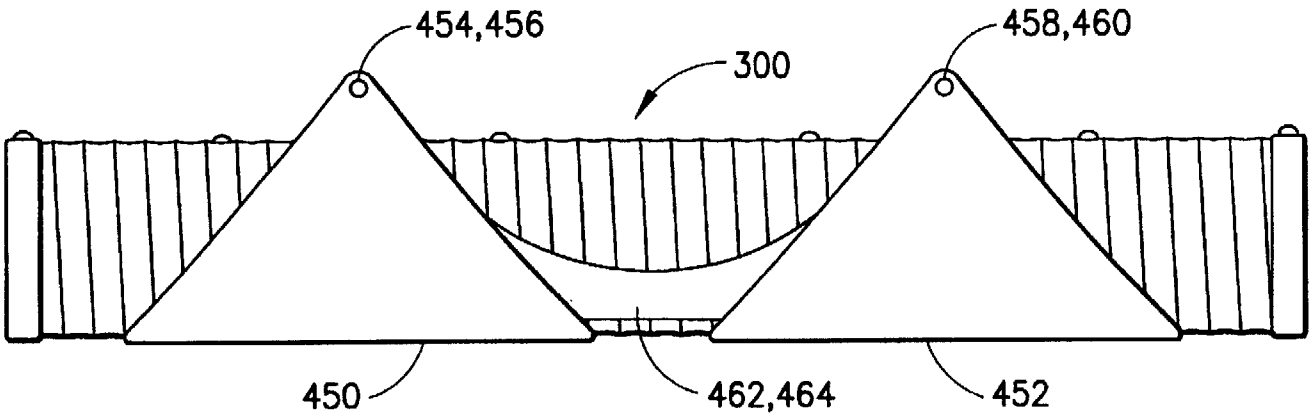
FIG. 5*a* is a longitudinal side elevation view of a first mounting system for the loudspeaker system of FIG. 5.
Figure 5B:
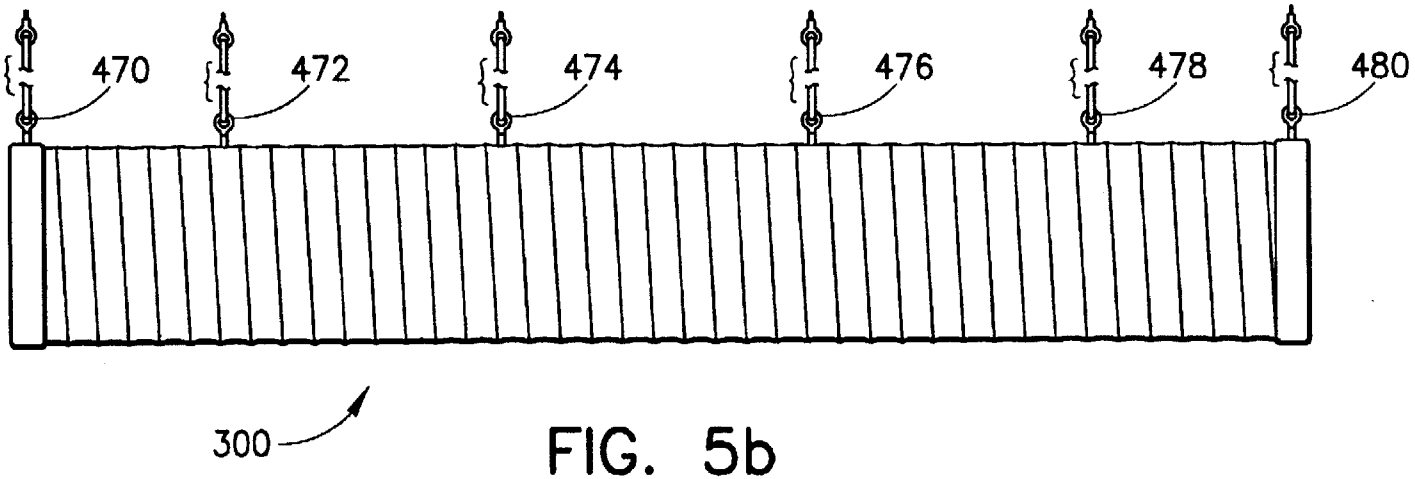
FIG. 5*b* is a longitudinal side elevation view of a second mounting system for the loudspeaker system of FIG. 5.
Figure 5C:
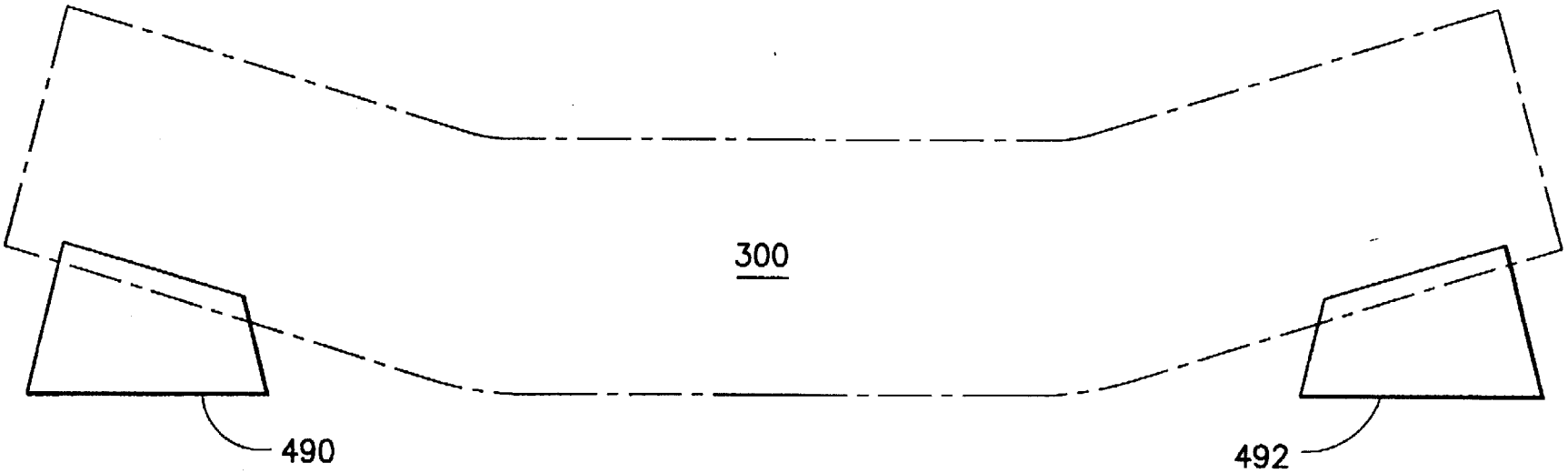
FIG. 5*c* is a longitudinal side elevation view of a third mounting system for the loudspeaker system of FIG. 5.
Figure 5E:
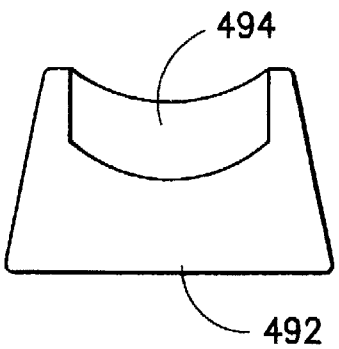
FIG. 5*e* is an interior end view of one of the components of the third mounting system for the loudspeaker system of FIG. 5.
Figure 5D:
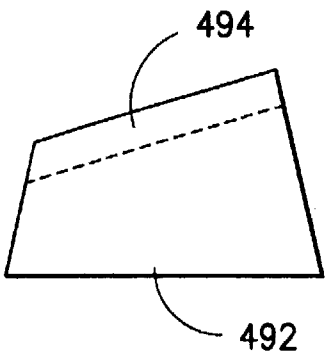
FIG. 5*d* is a longitudinal side elevation view of one of the components of the third mounting system for the loudspeaker system of FIG. 5.

The loudspeaker system 300 of FIG. 5 may be mounted in several different ways. For example, as seen in FIG. 5*a*, a pair of supporting "hammocks" 450, 452, each provided with eyelets 454, 456 and 458, 460 may be suspended by wires or cables (not shown) from a ceiling and the loudspeaker system 300 laid inside the hammocks. The hammocks 450, 452 may be joined by lateral fabric supports 462, 464 for decorative and/or structural purposes. Alternatively, as shown in FIG. 5*b*, the loudspeaker system 300 may be provided with a plurality of radially extending eyelets 470–480 which are attached to the tube(s) via internal supporting rings (not shown) and which may be coupled by links to cables suspended from a ceiling. In addition, the loudspeaker system 300 may be supported on a floor or shown relatively level surface, as shown in FIGS. 5*c*–5*e*, using a pair of supporting "shoes" 490, 492. Each shoe, e.g., shoe 492, has a substantially trapezoidal profile with an angled recessed top surface 494. The top surface 494 is curvilinear so as to cradle an end of the tube of the speaker system 300. The slope of the angled top surface is preferably approximately sixteen degrees, although other angles may be equally appropriate. The shoes are dimensioned to provide firm support for the ends of the tubes and the angles of the trapezoidal profile of the shoes are chosen for aesthetic and structural advantage. The shoes may be made of plastic, metal, wood, urethane foam, or any other suitable material. When made of urethane foam, they may be used as part of the packing material for the loudspeaker system.

Figure 6:
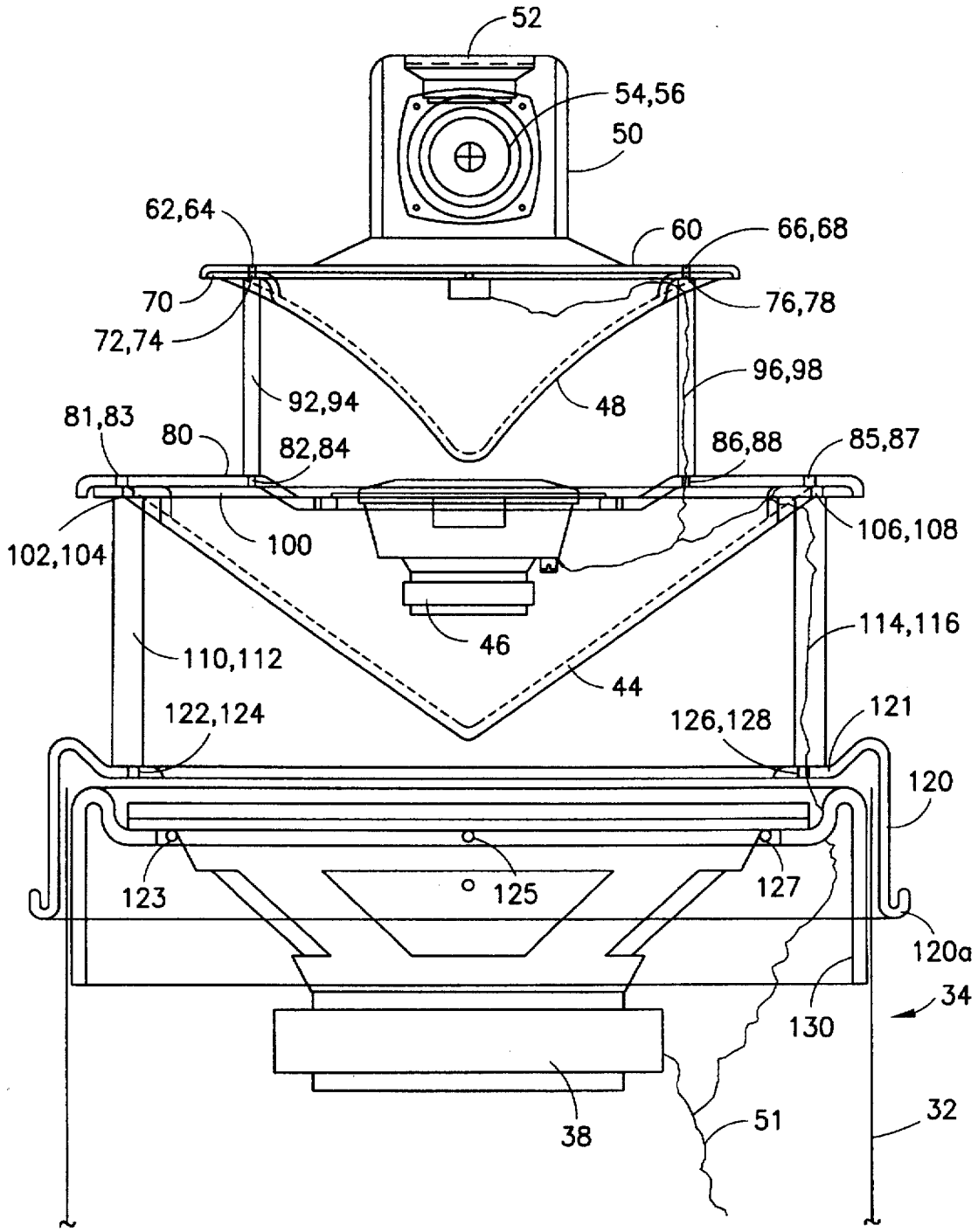
FIG. 6 is an enlarged transparent side elevation view of a portion of the loudspeaker system of FIG. 4.

FIG. 6 shows how the speakers and the lenses are mounted at the first end 34 of the tube 32. Before mounting the speakers and the lenses on the tube 32, they are coupled to each other as follows: The tweeters 52–56 are mounted in the tweeter housing 50 and the housing 50 is provided with a circular base 60 with four mounting holes 62, 64, 66, 68 which are substantially evenly spaced around the periphery of the base 60. The base of the midrange lens 48 is provided with a flange 70 having four mounting holes 72, 74, 76, 78 which align with the holes 62, 64, 66, 68 in the base 60 of the tweeter housing 50.

The midrange speaker 46 is mounted on an annular plate 80 which has four (preferably threaded) inner holes 82, 84, 86, 88 and four outer holes 81, 83, 85, 87. The base 60 of the tweeter assembly 50 is placed onto the flange 70 of the lens 48 and aligned so that the holes in the base 60 align with the holes in the flange 70. Four screws (not shown) are inserted through respective holes in the base and flange and four cylindrical posts 92, 94, 96, 98 are placed over the screws. The posts and the screws are aligned over the inner holes 82, 84, 86, 88 in the annular plate 80 and the screws are threaded into the holes 82, 84, 86, 88 (alternatively, they pass through the holes and are threaded with nuts). The woofer lens 44 is provided with a flange 100 having four mounting holes 102, 104, 106, 108 which align with the holes 81, 83, 85, 87 in the midrange speaker plate 80. The woofer lens 44 is aligned with the midrange speaker plate 80 and four screws (not shown) are passed through the aligned holes. Four cylindrical posts 110, 112, 114, 116 are placed over the screws and the screws are fastened to a first cylindrical member 120 which has an annular flange 121 with four holes 122, 124, 126, 128. The first cylindrical member 120 has an inner diameter which is slightly larger than the outer diameter of the tube 32 so that it may fit snugly over the first end 34 of the tube 32. As seen in FIG. 6, the first cylindrical member 120 is also provided with a curled lip flange 120*a* to facilitate the attachment of a fabric sleeve as described below.

The woofer 30 is mounted on a second cylindrical member 130 having an inner annular flange 132. The second cylindrical member 130 has an outer diameter which is slightly smaller than the inner diameter of the tube 32 so that may fit snugly within it. The second cylindrical member 130, with the woofer attached to it, is inserted into the first end 34 of the tube 32 and the first cylindrical member 120, with midrange speaker, tweeters, and lenses attached to it, is press fit over the end 34 of the tube. Preferably, the first cylindrical member 120 is provided with a plurality of radial holes, e.g. 123, 125, 127, through which screws (not shown) engage the end of the tube and the second cylindrical member 130.

The speakers are electrically coupled by wires 51 to the crossover 53 (FIGS. 4 and 5) which wires pass through holes in the cylindrical members 120, 130, the cylindrical posts, e.g. 96, 114, and the lenses 44, 48 as shown for example in FIG. 6.

Those skilled in the art will appreciate that the dimensions of the parts described above will depend on the diameter of the tube 32 and the dimensions of the speakers. Moreover, the lengths of the cylindrical posts and the dimensions and shapes of the lenses will depend on acoustical considerations. It will further be understood that the dimensions and shapes of the parts may be optimized by using acoustical engineering software. In a presently preferred embodiment, three 1.75 inch tweeters are mounted in the tweeter housing 50 which has a base 60 approximately 9.5 inches in diameter. The midrange lens 48 has a diameter of approximately 9.25 inches and a height of approximately 3.25 inches. A 5.25 inch midrange speaker is mounted on the annular plate 80 which has an outer diameter of approximately 14 inches. The posts 92, 94, 96, 98 between the tweeter base 60 and the annular plate 80 are approximately 3.5 inches long. The woofer lens 44 has a flange diameter of approximately 13.4 inches and an cross sectional apex angle of approximately 108 degrees. The first cylindrical member 120 has an inside diameter of approximately 14 inches and an overall height of 3.2 inches. The posts 110, 112, 114, 116 between the annular plate 80 and the first cylindrical member 120 are approximately 4.5 inches long. The tube 32 has an outer diameter of approximately 14 inches. A twelve inch woofer 38 is mounted on the second cylindrical member 130 which has an outer diameter of approximately 14 inches and an overall height of approximately 3.5 inches. All of the parts except for the speakers, posts and screws are preferably made of ABS plastic.

The second cylindrical member 130 is inserted into the end of the tube 32 and is secured to the tube by radially arranged rivets which pass through the tube into holes in the second cylindrical member 130. The first cylindrical member 120 is pressed over the end of the tube and is secured to the tube and the second cylindrical member by sheet metal screws which pass through holes in the first cylindrical member 120 and the tube 32, and engage holes in the second cylindrical member 130. The vented baffle 40 (FIGS. 4 and 5) may be attached to the other end of the tube using radially arranged rivets since the baffles will not likely need to be removed. It will be appreciated, however, that the cylindrical members may be fastened to the end of the tube in any appropriate manner as will be understood by those skilled in the art. In addition, it will be appreciated that rubber washers between the screws/rivets and the tube will help protect the tube and create a better fastening.

Figure 7:
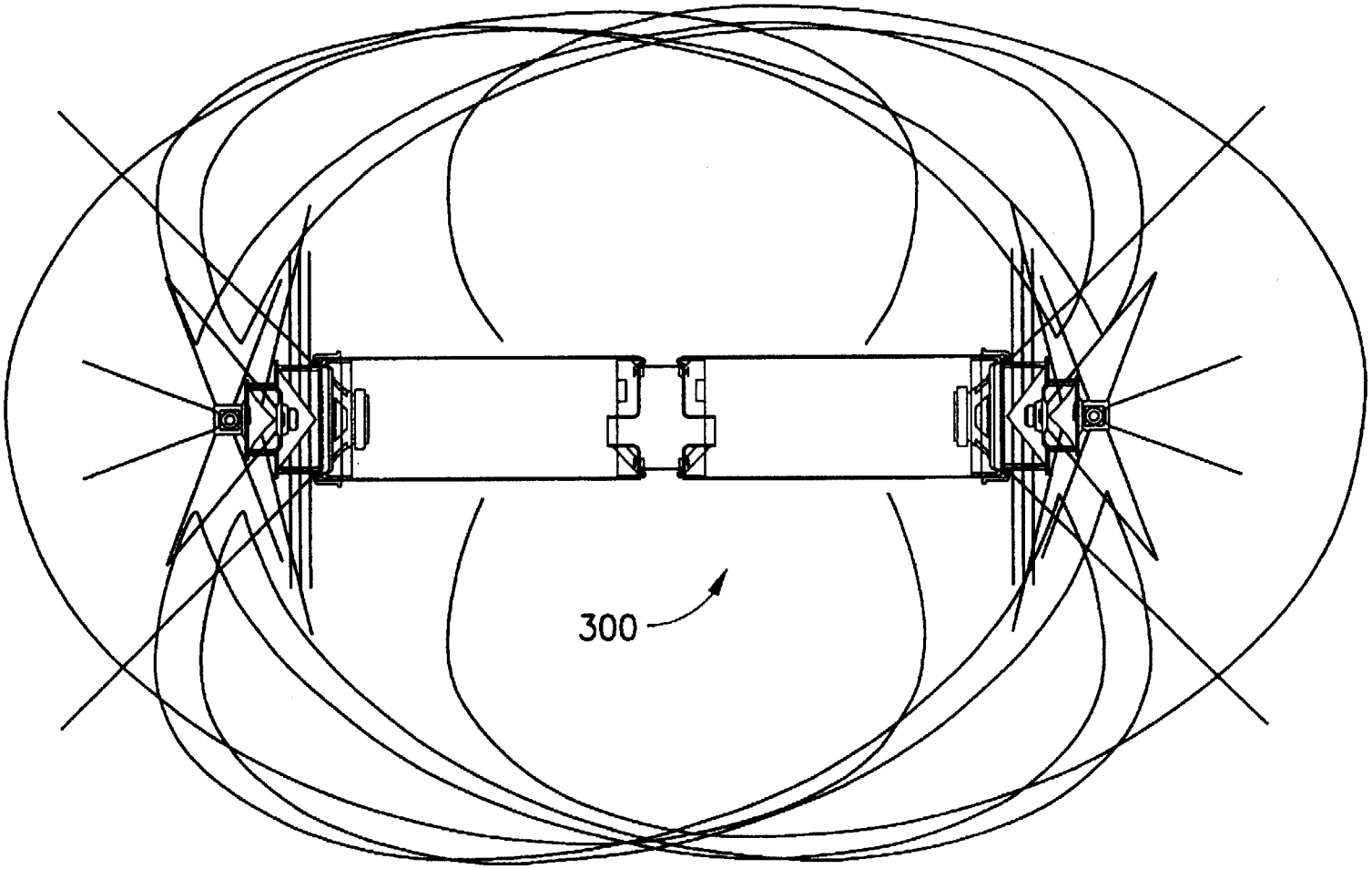
FIG. 7 is a schematic representation of the dispersion pattern of the loudspeaker system according to FIG. 5.

The loudspeaker system according to the invention has excellent sound dispersion capability as seen schematically in FIG. 7. The loudspeaker system achieves a 360 degree radial sound dispersion about the axis of the tube, the speakers and the lenses. In addition, the loudspeaker system achieves lobes of sound dispersion 90 degrees to the axis of the lenses. The radial dispersion and the lobe dispersion combine to provide a virtually omnidirectional dispersion pattern as shown schematically in FIG. 7.

Figure 8:
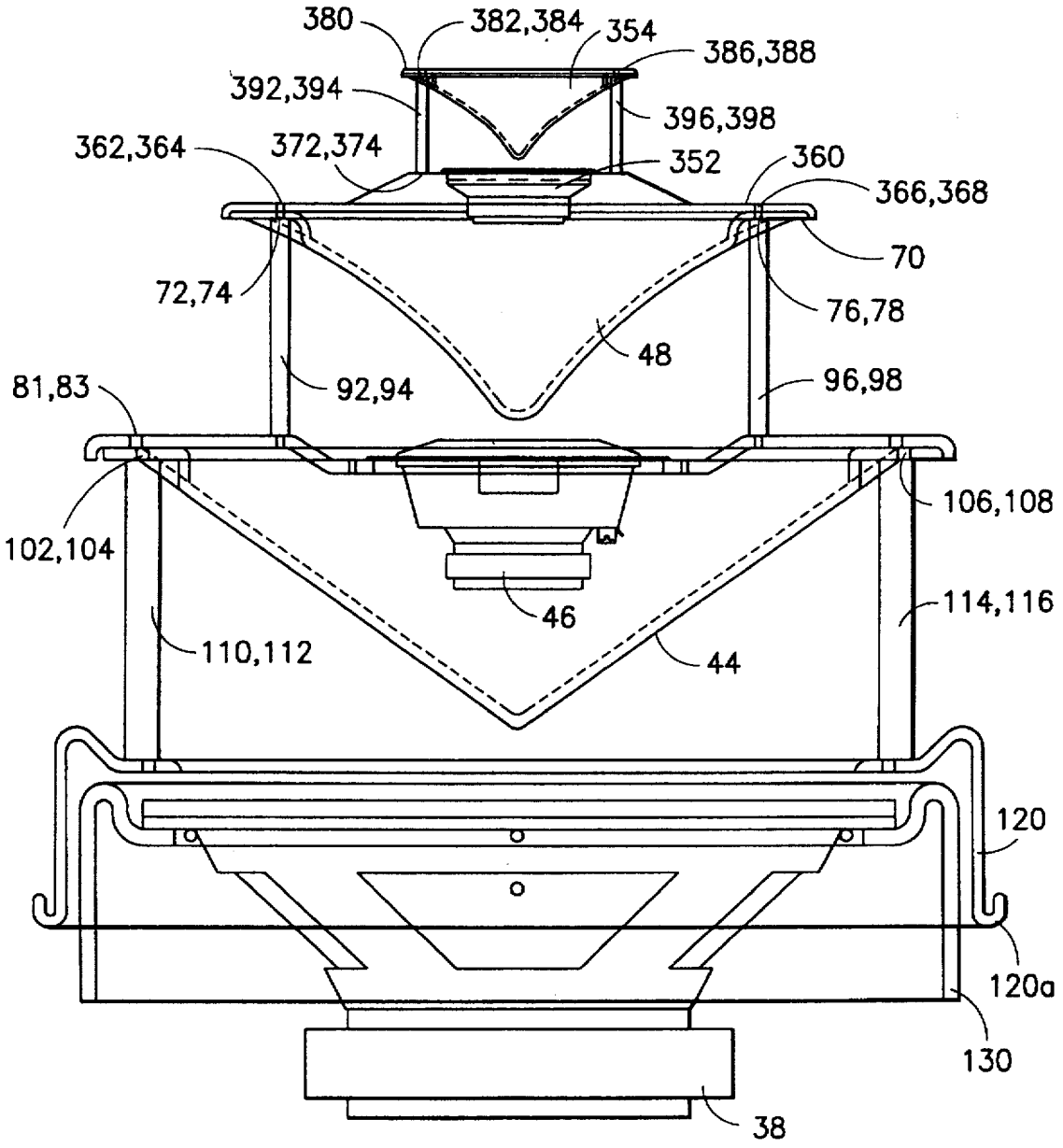
FIG. 8 is a view similar to FIG. 6 of a second embodiment of the loudspeaker system according to the invention.

High frequency sound dispersion may be somewhat enhanced by providing a tweeter lens as shown in FIG. 8. The embodiment of FIG. 8 is substantially the same as the embodiment of FIG. 6 having a woofer 38, a woofer lens 44, a midrange speaker 46, and a midrange speaker lens 48. In this embodiment, however, a single tweeter 352 is mounted on an annular plate 360 having outer holes 362, 364, 366, 368 for mating with the holes 72, 74, 76, 78 of the flange 70 on the midrange speaker lens 48. Additional inner holes 372, 374, 376, 378 are provided on the plate 360 for mounting a tweeter lens 354. The tweeter lens 354 has a convex surface of rotation and an annular flange 380 with mounting holes 382, 384, 386, 388. The tweeter lens 354 is mounted above the tweeter 352 using cylindrical posts 392, 394, 396, 398 which are aligned with the holes 382, 384, 386, 388 in the annular flange 380 and the holes 372, 374, 376, 378 in the annular plate 360. Screws (not shown) pass through the holes in the flange 380, through the posts 392, 394, 396, 398 and either engage the holes 372, 374, 376, 378 in the annular plate 360, if they are threaded, or pass through them and engage nuts (not shown).

Figure 8A:
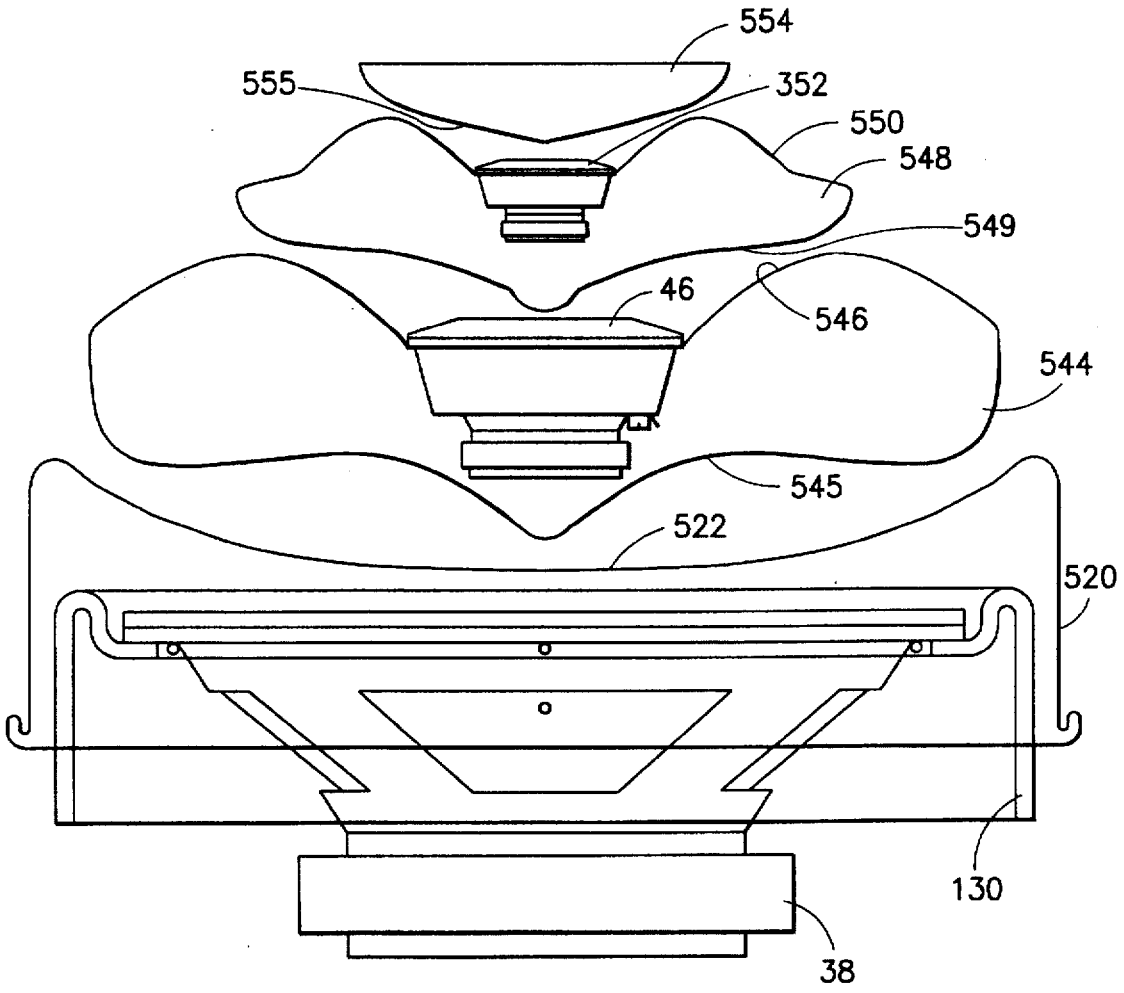
FIG. 8*a* is a view similar to FIG. 8 of an alternate embodiment of dispersion elements.
Figure 9:
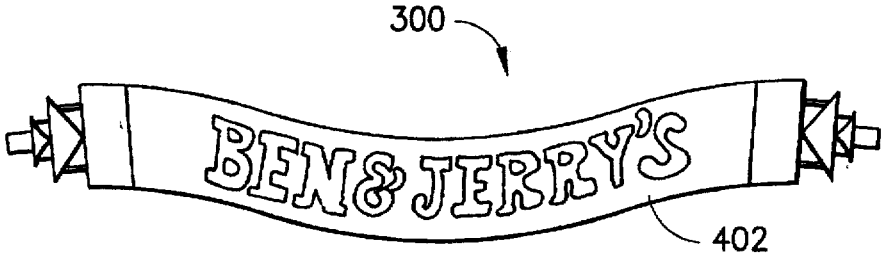
FIGS. 9–11 show the loudspeaker system according to the invention bearing graphically imprinted fabric sleeves.
Figure 10:
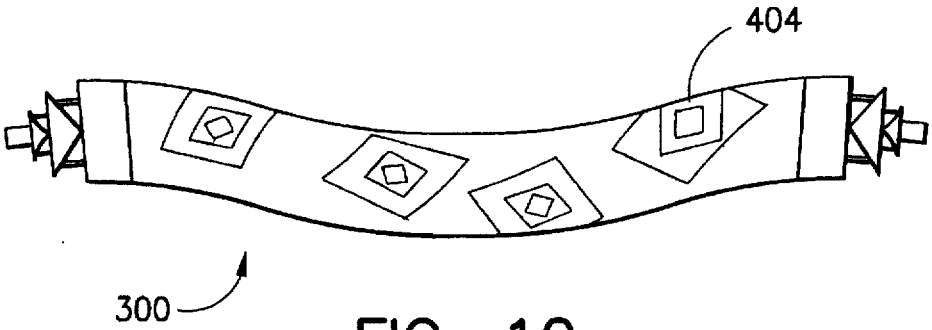
Figure 11:
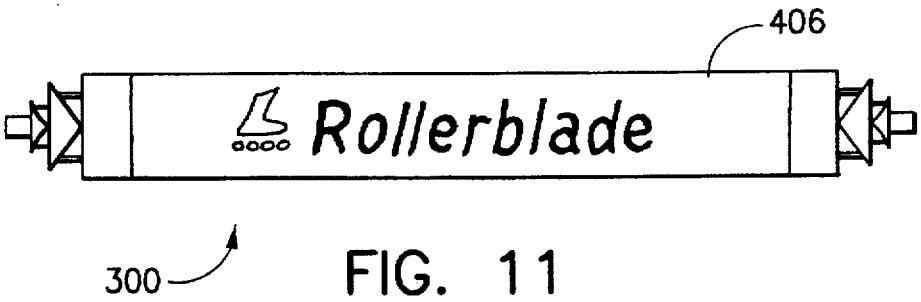

FIG. 8*a* schematically shows an alternate embodiment of sound dispersion elements or lenses which utilize a venturi effect. In this embodiment, the first cylindrical member 520 is provided with an exterior surface 522 which is substantially concave with its lowest portion lying above the center of the woofer 38. One or more holes (not shown) are provided in the surface 522 to allow air modulated by the woofer to exit through the cylindrical member 520. The woofer lens 544 has a lower surface 545 which is partially convex (at its center and outer edge portions) and partially concave (between the center and the edge). This creates a space between the first cylindrical member 52 and the woofer lens 544 which acts as a venturi to accelerate modulated air which exits radially from this space. In this embodiment, the midrange speaker 46 is mounted in a central concave portion the upper surface 546 of the woofer lens 544 and the upper surface 546 of the lens 544 has an outer annular convex portion surrounding the midrange speaker 46. The midrange speaker lens 548 is shaped similar to the woofer lens 544 having a lower surface 549 which is convex at its venter and its edge with a concave portion therebetween. The space thus formed between the upper surface 546 of the woofer lens 544 and the lower surface 549 of the midrange lens 548 accelerates air exiting radially from the space due to a venturi effect created by the narrowing gap between the surfaces at the outer edges of the surfaces. The upper surface 350 of the midrange lens 348 has a central concave portion within which the tweeter 352 is mounted and an outer convex portion surrounding the tweeter. The tweeter lens 554 has a substantially conical or convex lower surface 555. The space between the tweeter lens and the tweeter also provides a venturi effect on air modulated by the tweeter and exiting radially from this space. Those skilled in the art will appreciated that the construction of this embodiment of the invention may be substantially the same as the embodiment of FIG. 8, utilizing screws and cylindrical posts (not shown).

Figure 12:
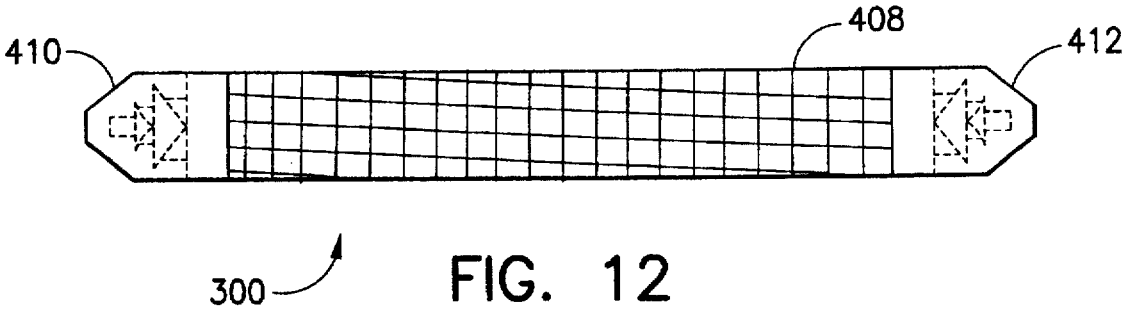
FIG. 12 shows the loudspeaker system according to the invention bearing a graphically imprinted fabric sleeve and two fabric end covers.

As mentioned above, the loudspeaker system 300 may be fitted with a fabric sleeve for decorative and/or promotional purposes. FIGS. 9–12 show a loudspeaker system 300 according to the invention with a variety of sleeves 402, 404, 406, 408. The sleeves are preferably made of a fabric such as Lycra®/Spandex®. The fabric is cut to a rectangular piece dimensioned to fit the flexible tubes of the speaker system and is printed flat. Opposite short edges of the sleeve are hemmed with an elastic tape. Opposite long edges of the rectangular fabric piece are stitched to form a cylindrical fabric sleeve. The sleeve is removably slipped over the flexible tubes of the speaker system as shown in FIGS. 9–13 and 13*a*–13*d*. The hemmed ends of the sleeve are restrained by the curled lip flange 120*a* (FIG. 6) on the first cylindrical member 120. The sleeve is preferably dimensioned for an optimum fit during actual use of the speaker system. An elastic, Lycra®/Spandex®, sleeve fits snug against the tube when the tube is flexed, bent, stretched, etc. When the tube is fully compressed, the Lycra®/Spandex® sleeve clings to and follows the surface of the tube so that there is no sagging or bunching. Optionally, a pair of Lycra®/Spandex® caps 410, 412 are provided to cover the lenses at the ends of the tubes as shown in FIG. 12. The caps protect the speakers from environmental conditions and provide an alternative appearance for the entire speaker system. Those skilled in the art will appreciate that the Lycra®/Spandex® fabric is air permeable and will not interfere with sound reproduction or with the expanding and collapsing of the flexible tubes.

Turning now to FIGS. 13, and 13*a*–13*d*, a loudspeaker system 300 according to the invention is fitted with a fabric sleeve 414, which, in this case, is imprinted with a logotype 416. The sleeve 414 is bunched into a roll and slipped over one end of the tube(s) of the speaker system 300. The first hemmed end 418 of the sleeve 414 is engaged by the lip 120*a* on one of the first cylindrical members 120. The other hemmed end 420 is pulled towards the other first cylindrical member 120' and is engaged by the lip 120*a*' on the other first cylindrical member 102'. The sleeve 414, in this embodiment, is provided with a plurality of small holes 482, 484, 486 which allow the radially extending mounting eyelets 472, 474, 476 on the speaker system 300 to extend through the sleeve 414. The sleeve 414 is also provided with a centrally located hole 488 for exposing the terminals 153, 153*a* by which the speaker system 300 is electrically connected to an audio source.

There have been described and illustrated herein several embodiments of an omni-directional loudspeaker system. While particular embodiments of the invention have been described, it is not intended that the invention be limited thereto, as it is intended that the invention be as broad in scope as the art will allow and that the specification be read likewise. Thus, while particular dimensions have been disclosed, it will be appreciated that other dimensions could be utilized. Also, while three-way speaker systems have been shown, it will be recognized that a two-way speaker system may be constructed having many of the features of the invention by eliminating the midrange speaker and using an extended range woofer or coaxial speaker. Moreover, while particular configurations have been disclosed in reference to particular hardware used to mount the speakers and the lenses to the end of the flexible tube, it will be appreciated that other configurations could be used as well. Furthermore, while the stereo speaker system according to the invention has been disclosed as having two flexible tubes which are coupled together, it will be understood that a single flexible tube with speakers and lenses mounted at opposite ends can achieve a similar function as disclosed herein. In addition, while the presently preferred fabric sleeve has been disclosed as Lycra®/Spandex®, it will be appreciated that other materials could be used. It will therefore be appreciated by those skilled in the art that yet other modifications could be made to the provided invention without deviating from its spirit and scope as so claimed.

I claim:

1. A loudspeaker system comprising:

a) a first flexible compressible tube having a first and second end;

b) a first loudspeaker mounted on said first end of said tube such that the cone of said first loudspeaker faces away from said tube;

c) a first sound dispersion element having a substantially conical surface, said first sound dispersion element being coupled to said first end of said tube such that the apex of said substantially conical surface faces said cone of said first loudspeaker;

d) at least one tweeter coupled to said first sound dispersion element such that the cone of said tweeter faces away from said tube;

e) a second loudspeaker; and f) a second sound dispersion element having a substantially conical surface, wherein said second loudspeaker is mounted on said first sound dispersion element such that the cone of said second loudspeaker faces away from said tube, said second sound dispersion element is mounted on said first sound dispersion element such that the apex of said substantially conical surface of said second sound dispersion element faces said cone of said second loudspeaker, and said tweeter is mounted on said second sound dispersion element.

2. A loudspeaker system according to claim 1, further comprising:

g) a vented baffle mounted on said second end of said tube.

3. A loudspeaker system according to claim 1, further comprising:

g) a tweeter sound dispersion element having a sound reflecting surface which faces the cone of said tweeter.

4. A loudspeaker system according to claim 1, wherein:

said second sound dispersion element has a convex surface of rotation.

5. A loudspeaker system comprising:

a) a first flexible compressible tube having a first and second end;

b) a first loudspeaker mounted on said first end of said tube such that the cone of said first loudspeaker faces away from said tube;

c) a first sound dispersion element having a substantially conical surface, said first sound dispersion element being coupled to said first end of said tube such that the apex of said substantially conical surface faces said cone of said first loudspeaker; and d) at least one tweeter coupled to said first sound dispersion element such that the cone of said tweeter faces away from said tube, wherein said at least one tweeter comprises three tweeters, each of said three tweeters facing in a different direction and each of said three tweeters facing away from said tube.

6. A loudspeaker system according to claim 1, further comprising:

g) a second flexible compressible tube having a first and second end;

h) a second loudspeaker mounted on said first end of said second tube such that the cone of said second loudspeaker faces away from said second tube;

i) a second sound dispersion element having a substantially conical surface, said second sound dispersion element being coupled to said first end of said second tube such that the apex of said substantially conical surface faces said cone of said second loudspeaker; and j) at least one second tweeter coupled to said second sound dispersion element such that the cone of said second tweeter faces away from said second tube.

7. A loudspeaker system comprising:

a) a first flexible compressible tube having a first and second end;

b) a first loudspeaker mounted on said first end of said tube such that the cone of said first loudspeaker faces away from said tube;

c) a first sound dispersion element having a substantially conical surface, said first sound dispersion element being coupled to said first end of said tube such that the apex of said substantially conical surface faces said cone of said first loudspeaker;

d) at least one tweeter coupled to said first sound dispersion element such that the cone of said tweeter faces away from said tube;

e) a second flexible compressible tube having a first and second end;

f) a second loudspeaker mounted on said first end of said second tube such that the cone of said second loudspeaker faces away from said second tube;

g) a second sound dispersion element having a substantially conical surface, said second sound dispersion element being coupled so said first end of said second tube such that the apex of said substantially conical surface faces said cone of said second loudspeaker;

h) at least one second tweeter coupled to said second sound dispersion element such that the cone of said second tweeter faces away from said second tube; and i) a vented baffle mounted on said second end of said second tube.

8. A loudspeaker system according to claim 7, wherein:

said first and second baffles are coupled to each other.

9. A loudspeaker system according to claim 8, further comprising:

l) a third loudspeaker;

m) a fourth loudspeaker;

n) a third sound dispersion element having a substantially conical surface; and m) a fourth sound dispersion element having a substantially conical surface, wherein said third loudspeaker is mounted on said first sound dispersion element such that the cone of said second loudspeaker faces away from said first tube, said third sound dispersion element is mounted on said first sound dispersion element such that the apex of said substantially conical surface of said third sound dispersion element faces said cone of said third loudspeaker, said tweeter is mounted on said third sound dispersion element, said fourth loudspeaker is mounted on said second sound dispersion element such that the cone of said second loudspeaker faces away from said second tube, said fourth sound dispersion element is mounted on said second sound dispersion element such that the apex of said substantially conical surface of said fourth sound dispersion element faces said cone of said fourth loudspeaker, and said second tweeter is mounted on said fourth sound dispersion element.

10. A loudspeaker system according to claim 9, wherein:

said second and fourth sound dispersion elements have a convex surface of rotation.

11. A loudspeaker system according to claim 8, wherein:

said at least one tweeter comprises three tweeters, each of said three tweeters facing in a different direction and each of said three tweeters facing away from said first tube, and said at least one second tweeter comprises three tweeters, each of said three second tweeters facing in a different direction and each of said three second tweeters facing away from said second tube.

12. A loudspeaker system according to claim 8, further comprising:

l) a fabric sleeve removably covering said first and second tubes.

13. A loudspeaker system according to claim 12, wherein:

said fabric sleeve is imprinted with a design.

14. A loudspeaker system according to claim 12, wherein:

said fabric sleeve is imprinted with an advertisement.

15. A loudspeaker system according to claim 12, further comprising:

m) a first fabric cap removably covering said at least one tweeter and said first sound dispersion element; and n) a second fabric cap removably covering said at least one second tweeter and said second sound dispersion element.

16. A loudspeaker system according to claim 1, further comprising:

g) a vertical mounting stand having a plurality of upstanding legs supporting a substantially circular collar, said first flexible tube being embraced by said collar so that the cone of said first loudspeaker faces upward.

17. A loudspeaker system according to claim 1, further comprising:

g) a plurality of radially arranged eyelets coupled to said tube for suspending said tube.

18. A loudspeaker system according to claim 6, further comprising:

k) a plurality of radially arranged eyelets coupled to said tubes for suspending said tubes.

19. A loudspeaker system according to claim 1, further comprising:

g) a supporting member having an inclined concave surface adapted to receive and support said first end of said flexible compressible tube.

20. A loudspeaker system according to claim 6, further comprising:

k) a first supporting member having an inclined concave surface adapted to receive and support said first end of said first flexible compressible tube; and l) a second supporting member having an inclined concave surface adapted to receive and support said first end of said second flexible compressible tube.

21. A loudspeaker system according to claim 1, further comprising:

g) a hammock for suspending said first flexible compressible tube.

22. A loudspeaker system according to claim 6, further comprising:

k) a hammock for suspending said first and second flexible compressible tubes.

23. A loudspeaker system comprising:

a) a first flexible compressible tube having a first and second end;

b) a first loudspeaker mounted on said first end of said tube such that the cone of said first loudspeaker faces away from said tube;

c) a first sound dispersion element having a first continuous surface which is partially convex on an outer portion thereof and partially concave on an inner portion thereof, said first sound dispersion element being coupled to said first end of said tube such that said first surface faces said cone of said first loudspeaker; and d) at least one tweeter coupled to said first sound dispersion element such that the cone of said tweeter faces away from said tube.

24. A loudspeaker system according to claim 23, further comprising:

e) a first cylindrical member having a first partially concave end surface, said first cylindrical member being mounted over said first loudspeaker such that said first partially concave end surface faces said first partially convex and partially concave surface.

25. A loudspeaker system according to claim 23, further comprising:

e) a tweeter sound dispersion element having a sound reflecting surface which faces the cone of said tweeter.

26. A loudspeaker system according to claim 25, further comprising:

f) a first annular convex surface which substantially surrounds the cone of said tweeter and faces said sound reflecting surface of said tweeter sound dispersion element.

27. A loudspeaker system according to claim 26, further comprising:

g) a second loudspeaker; and h) a second sound dispersion element having a second partially convex and partially concave surface, wherein said second loudspeaker is mounted on said first sound dispersion element such that the cone of said second loudspeaker faces away from said tube, said second sound dispersion element is mounted on said first sound dispersion element such that second partially convex and partially concave surface of said second sound dispersion element faces said cone of said second loudspeaker, and said tweeter is mounted on said second sound dispersion element.

28. A loudspeaker system according to claim 27, further comprising:

i) a second annular convex surface substantially surrounding the cone of said second loudspeaker and faces said second partially convex and partially concave surface.

29. A loudspeaker system according to claim 23, further comprising:

e) a vertical mounting stand having a plurality of upstanding legs supporting a substantially circular collar, said first flexible tube being embraced by said collar so that the cone of said first loudspeaker faces upward.

30. A loudspeaker system according to claim 23, further comprising:

e) a supporting member having an inclined concave surface adapted to receive and support said first end of said flexible compressible tube.

31. A loudspeaker system according to claim 23, further comprising:

e) a hammock adapted to suspend said first flexible compressible tube.

* * * * *